United States Patent [19]

Lewis

[11] 4,362,285

[45] Dec. 7, 1982

[54] CHANNEL MOUNTING HOOK SUPPORT

[75] Inventor: Lawrence A. Lewis, Englewood, N.J.

[73] Assignee: Clip Strip Corporation, South Hackensack, N.J.

[21] Appl. No.: 173,457

[22] Filed: Jul. 30, 1980

[51] Int. Cl.[3] ..... A47G 25/00

[52] U.S. Cl. ..... 248/221.3; 248/221.4

[58] Field of Search ..... 248/221.3, 220.4, 222.2, 248/227, 223.4, 224.2, 307, 225.1, 221.4

[56] References Cited

U.S. PATENT DOCUMENTS

| | | | |
|---|---|---|---|
| 1,509,407 | 9/1924 | MacQuarrie | 248/307 |
| 3,198,469 | 8/1965 | Callanan | 248/220.4 |
| 3,297,290 | 1/1967 | Patterson | 248/221.4 |
| 3,815,756 | 6/1974 | Cox | 248/221.4 X |
| 4,215,840 | 8/1980 | Babberl | 248/221.4 |
| 4,301,987 | 11/1981 | Conway | 248/307 X |
| 4,308,961 | 1/1982 | Kunce | 248/307 X |

FOREIGN PATENT DOCUMENTS

| | | | |
|---|---|---|---|
| 2706002 | 8/1978 | Fed. Rep. of Germany | 248/221.4 |

*Primary Examiner*—William H. Schultz
*Assistant Examiner*—Ramon O. Ramirez
*Attorney, Agent, or Firm*—Brooks, Haidt, Haffner & Delahunty

[57] ABSTRACT

A support for a hook for displaying articles, such support being insertable into a C-shaped channel secured to a shelf and being slidable therealong. The support has a body with a tapered first edge portion, an opposite side and a pair of lateral sides. A resilient arm extends from each lateral side, and each arm has a tapered lower portion and a post extending from adjacent a free end thereof. The body also has a projection extending from its face which has a pair of aligned openings for detachably receiving a hook. The tapered first edge portion and the tapered portions of the arms fit into recesses in the channel.

13 Claims, 5 Drawing Figures

CHANNEL MOUNTING HOOK SUPPORT

This invention relates to a support for article suspending devices which is receivable in a channel of the type frequently used in stores to display a tag bearing the price of articles supported on a shelf to which the channel is attached.

Many stores, such as supermarkets, display articles for sale on shelves. The price of the articles usually is on a tag or card attached to the shelf below the articles to which the price applies. Since the articles or prices are changed, it is customary to secure the tag or card to the shelf by means which permits easy removal of the tag or card. Also, the space on a shelf occupied by the articles may be changed, and therefore, it is desirable to secure the tag or card to the shelf in a manner which permits easy adjustment of the position of the tag or card along the length of the shelf. One common method of accomplishing these objectives is to secure a channel which is C-shaped in cross-section to the shelf side edge portion, such as by screws or nails, with the open side of the channel facing away from the shelf and to insert the tag or card in such channel. The tag or card may be adjusted in position by sliding it along the channel.

It is sometimes desirable to be able to also display articles on a hook extending outwardly from a shelf, and it is known to use a metal hook, known as a "J-hook", with a spring clip base which fits into the aforesaid channel. However, such hooks are relatively expensive, become lost or thrown out causing a high replacement cost and have to be removed as a whole after the articles supported thereby are depleted.

One object of the invention is to provide a support for a hook which can be readily inserted into or removed from the aforesaid channel and which can be readily slid therealong but which need not be removed from the channel when the hook, which is separable from the support, is removed. In this way, relatively inexpensive hooks, such as hooks formed from a plastic material, may be used thereby reducing replacement costs. When the support is retained in the channel, it is less likely to become lost.

Another object of the invention is to provide such a support which may be used in channels of various widths.

In accordance with the preferred embodiment of the invention, the support is made of a resilient plastic material with a body which fits between the inturned side edge portions of a channel. The upper edge portion of the body is tapered in cross-section to fit into the space between one inturned edge portion and the channel body and the lower portion of the body has a pair of resilient arms extending oppositely therefrom and in the direction of the length of the channel. The lower edge portions of the arms are tapered in cross-section to fit into the space between the other inturned edge portion and the channel body. The arms have posts thereon which facilitate bending of the arms and hence, insertion of the support into, and removal of the support from, the channel. The body of the support also has a projection thereon which extends away from the channel and which has aligned holes into which a removable hook may be inserted for suspending articles to be displayed.

Other objects and advantages of the present invention will be apparent from the following detailed description of the presently preferred embodiments thereof, which description should be considered in conjunction with the accompanying drawings in which.

Figure 1:
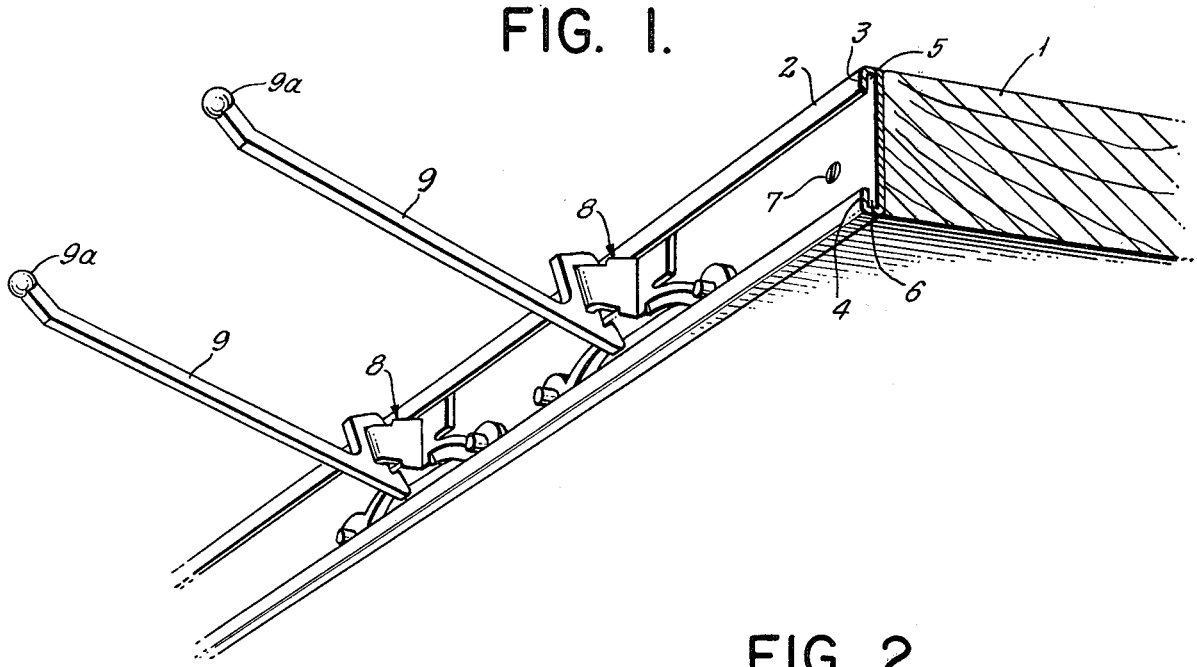
FIG. 1 is a perspective view of a shelf for supporting articles with a channel secured to the shelf and with supports of the invention in the channel, the supports having hooks therein.

With reference to FIG. 1, a shelf 1, usually made of wood but which may be made of other materials, may be used to support, on the top thereof, articles to be displayed. A channel 2 which is C-shaped in cross-section and which has inturned edge portions 3 and 4 to provide recesses 5 and 6 is secured to the side face of the shelf 1, such as by screws 7.

A pair of supports 8 of the invention are shown slidably received in the channel 2 and support a pair of hooks 9 which may be of the type described in my copending application Ser. No. 173,817, filed July 30, 1980 and entitled "Display Rack". Articles to be displayed outwardly from the side face of the shelf 1 may be suspended from the hooks 9.

Figure 2:
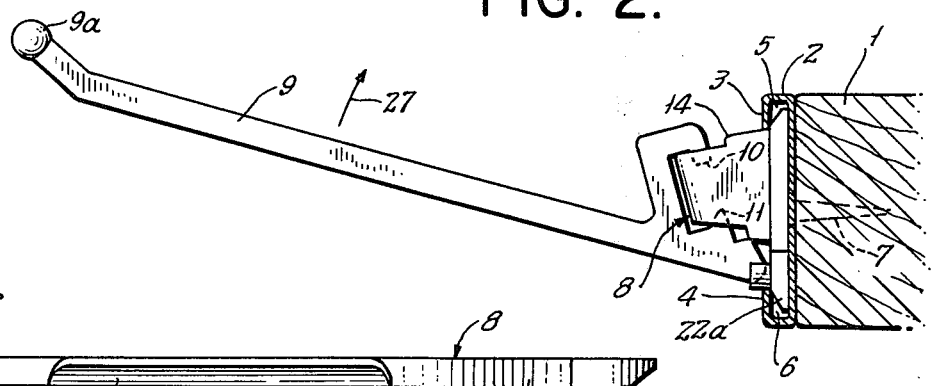
FIG. 2 is a side elevation view, partly in cross-section, of the embodiment shown in FIG. 1.
Figure 3:
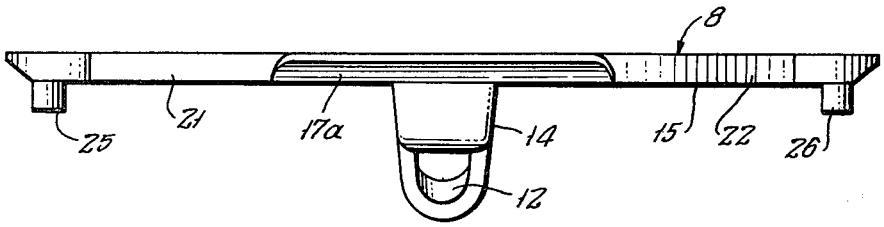
FIGS. 3, 4 and 5 are respectively plan, front elevation and side elevation views, the latter partly in cross-section, of the support of the invention.
Figure 4:
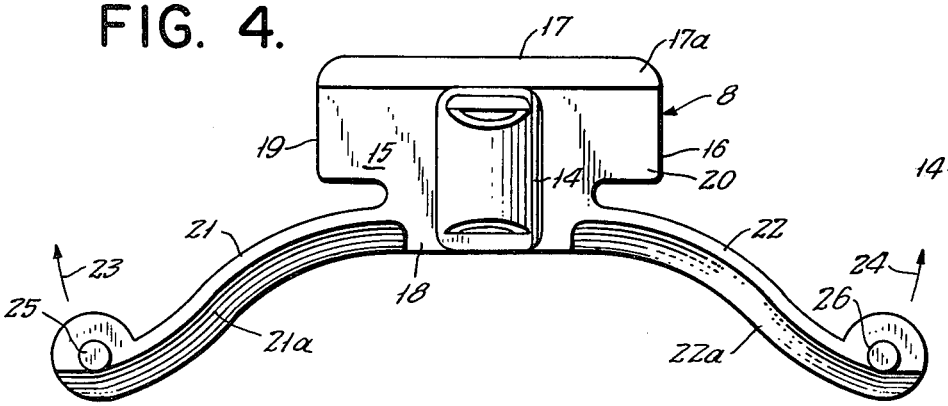

As illustrated in FIGS. 1 and 2, the hooks 9 are relatively long and narrow and have a free end 9*a* for receiving an article to be displayed. Each hook has a pair of legs 10 and 11 receivable with a snap fit in openings 12 and 13 (FIG. 5) in a hollow projection 14 on a face 15 of the main body 16 of the support 8. The openings 12 and 13 are aligned along a line which extends at an acute angle to the plane of the face 15 so that the hooks 9 will assume the positions shown in the drawings.

Figure 5:
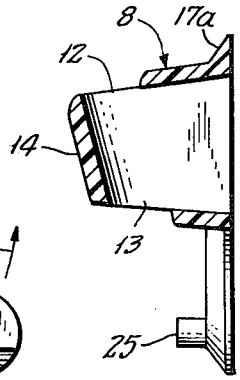

The body 16 has a first side 17, an opposite side 18 and a pair of lateral sides 19 and 20 extending between the first side 17 and the opposite side 18. The portion 17*a* of the body 16 adjacent the first side 17 is tapered in cross-section, as indicated in FIGS. 2 and 5, so as to fit readily into the recess 5. Preferably, the thickness and dimension of the portion in the direction parallel to the face 15 are such that the portion 17*a* wedges into the recess 15 to prevent looseness of the support 8 when it is in the channel 2 and so that the support may be used with recesses 5 of varying dimensions.

A pair of resilient arms 21 and 22 extend respectively from the sides 19 and 20 and their lower portions 21*a* and 22*a* are tapered in cross-section so as to fit readily into the recess 6. Preferably, such portions 21*a* and 22*a* are dimensioned like the portion 17*a* for similar reasons. The arms 21 and 22 are movable in the direction of the arrows 23 and 24, and although they may be made of a material different from the body 16 and be secured to the body 16 by known means, it is preferred that the support 8 be made, as one integral unit, of an acetal copolymer resin such as the acetal copolymer resin sold under the trademark CELCON by Celanese Plastics Materials Co., Chatham, N.J. Arms 21 and 22 made of such resin may be bent repeatedly by substantial amounts and will still return to their original shapes. A spacing between the side 17 and the lowermost edges of the portions 21*a* and 22*a* of about one-and-one-half inches will permit the support 8 to be used with channels varying in width from one to one-and-one-half inches which permits the use of the support 8 with about 95% of the channels 2 in use at this time.

The arm 21 has a post 25 thereon, and the arm 22 has a post 26 thereon to aid in removing a support 8 from a channel. The posts 25 and 26 also engage the upper face of the inturned edge portion 4. Thus, when it is desired to remove a support 8 from a channel 2, the posts 25 and 26 may be engaged to lift the arms 21 and 22 until the lower portions thereof are out of the recess 6 at which time the lower portion of the support 8 may be moved forward and removed from the channel 2.

To insert the support 8 in a channel 2, either the side 17 may be inserted in the recess 5 and the arms 21 and 22 may be raised by the posts 25 and 26 until the lower portions thereof may be inserted in the recess 6, or the lower portions of the arms 21 and 22 may be inserted into the recess 6 and the support 8 may be pushed down until the portion 17*a* may be inserted into the recess 5.

After a support 8 is placed in a channel 2, it may be slid lengthwise of the channel by pushing on the support 8 or one or both of the posts 25 and 26 in the direction of the length of the channel 2.

The hooks 9 may be mounted on the supports 8 either before or after the supports 8 are placed in the channel 2. However, it is not necessary to remove a support 8 with its associated hook 9 in order to take a hook 9 out of the way. Instead, the support 8, which projects only a short distance from the shelf 1, may be left in place, and the associated hook 9 may be removed by moving the hook 9 in the direction of the arrow 27 (FIG. 2) until the leg 11 comes out of the opening 13 at which time the leg 10 may be removed from the opening 12. By removing only the hook 9, which is relatively inexpensive, and leaving the more expensive support 8 in place in a channel 2, it is less likely that the support 8 will be lost. Therefore, if it is necessary to replace only the hook 9, replacement costs are reduced as compared to prior art combined hooks and supports used with channels 2.

Furthermore, the support 8 of the invention may be used with channels 2 having relatively widely varying dimensions, and the tapered portions 17*a*, 21*a* and 22*a* provide snug fits with recesses 5 and 6 of varying dimensions and prevent looseness of the support 8. When the support 8 is made of a plastic material, the resilience of the arms 21 and 22 provides sufficient force to maintain the support 8 in its position lengthwise of the channel 2 but permits sliding of the support 8 along a channel 2 without requiring large forces. The sliding forces may be reduced by lifting the posts 25 and 26 as the support 8 is slid along the channel 2.

Although preferred embodiments of the present invention have been described and illustrated, it will be apparent to those skilled in the art that various modifications may be made without departing from the principles of the invention.

I claim:

1. A support for a hook, said support being receivable in spaced portions of a C-shaped channel and comprising:

a body having a first side having a pair of ends, a second, opposite side and a pair of lateral sides extending from the ends of the first side to the opposite side, said first side being receivable in a portion of said channel;

a projection on a face of said body in spaced relation to said first side, said projection having at least one aperture therein for receiving a hook, the axis of said aperture extending in a direction substantially perpendicular to a rectilinear line between said ends of said first side and extending at an angle less than 90° with respect to the plane of said face of said body;

a first resilient arm extending from a lateral side of said body other than said first side and in a direction parallel to the plane of said face, said arm having a portion receivable in another portion of said channel and said portion being disposed at the sides of said projection opposite from the sides of said projection at which said first side and one of said lateral sides are disposed; and a second resilient arm extending in a direction substantially parallel to the plane of said face and from a lateral side of said body other than said first side and other than the side from which said first arm extends, said second arm having a portion receivable in said other portion of said channel and said portion of said second arm being disposed at the sides of said projection opposite from the sides of said projection at which said first side and the other of said lateral sides are disposed.

2. A support as set forth in claim 1 further comprising a post on each of said arms adjacent the end thereof remote from said body and extending away from the plane of said face with the free end of each post at the same side of said face as said projection.

3. A support as set forth in claim 1 or 2 wherein said projection is hollow and has a pair of hook receiving apertures therein, said apertures being aligned along a line extending at an acute angle with respect to the plane of said face of said body.

4. An article supporting device comprising a hook and a support therefor, said support being receivable in a C-shaped channel, said device comprising:

a support having a first side, an opposite side and a pair of lateral sides extending between the first side and the opposite side, said first side being receivable in a portion of said channel;

a hollow projection on a face of said body in spaced relation to said first side, said projection having a pair of spaced apertures therein for receiving a hook, said apertures being aligned along a line extending at an acute angle with respect to the plane of said face of said body;

a first resilient arm extending from one lateral side of said body, said arm having a portion receivable in another portion of said channel;

a second resilient arm extending from the other lateral side of said body, said second arm having a portion receivable in said other portion of said channel; and a relatively long and narrow hook having a free end and an opposite end, said opposite end of the hook having a pair of legs extending transversely to the length of said hook and toward each other but with the free end of one leg spaced from the free end of the other leg, said legs being detachably received in respective said apertures in said projection.

5. A device as set forth in claim 4 further comprising a post on each of said arms adjacent the end thereof remote from said body and extending away from the plane of said face with the free end of each post at the same side of said face as said projection.

6. A device as set forth in claim 5 wherein said leg of said hook is in one of said apertures and said hook has a further leg extending toward said first-mentioned leg but having its free end spaced from the free end of said first-mentioned leg, said further leg being detachably received in the other of said apertures.

7. In combination with a C-shaped channel having inturned edge portions providing a pair of spaced, longitudinally extending and facing recesses, an article supporting device comprising:

a support body having a first side having a pair of ends, a second, opposite side and a pair of lateral sides extending from the ends of the first side to the opposite side;

a projection on a face of said body in spaced relation to said first side, said projection having at least one aperture therein for receiving a hook, the axis of said aperture extending in a direction substantially perpendicular to a rectilinear line between said ends of said first side and extending at an angle less than 90° with respect to the plane of said face of said body;

a first resilient arm extending from one lateral side of said body and in a direction parallel to the plane of said face; and a second resilient arm extending from the other lateral side of said body and in a direction parallel to the plane of said face, said body being mounted on said channel with said first side in one of said recesses, with a portion of each of said arms in the other of said recesses and with said face of said body facing away from said channel.

8. The combination as set forth in claim 7 wherein said support further comprises a post on each of said arms adjacent the end thereof remote from said body and extending away from the plane of said face with the free end of each post at the same side of said face as said projection, each of said posts extending outwardly of said other of said recesses.

9. The combination as set forth in claim 7 or 8 further comprising a relatively long and narrow hook with a free end and an opposite end, said opposite end having a leg extending transversely to the length of said hook, said leg being detachably received in said aperture in said projection.

10. The combination as set forth in claim 9 wherein said leg of said hook is in one of said apertures and said hook has a further leg extending toward said first-mentioned leg but having its free end spaced from the free end of said first-mentioned leg, said further leg being detachably received in the other of said apertures.

11. A support for a hook, said support being receivable in a C-shaped channel and comprising:

a body having a first side, an opposite side and a pair of lateral sides extending between the first side and the opposite side, said first side being receivable in a portion of said channel and the portion of said body adjacent said first side decreasing in thickness, in cross-section, in the direction toward said first side;

a hollow projection on a face of said body in spaced relation to said first side, said projection having a pair of spaced apertures therein for receiving a hook, said apertures being aligned along a line extending at an acute angle with respect to the plane of said face of said body;

a first resilient arm extending from a side of said body other than said first side, said arm having a portion which is receivable in another portion of said channel and which decreases in thickness in the direction away from said first side; and a second resilient arm extending from a lateral side of said body other than said first side and other than the side from which said first arm extends, said second arm having a portion which is receivable in said other portion of said channel and which decreases in thickness in the direction away from said first side.

12. An article supporting device comprising a hook and a support therefor, said support being receivable in a C-shaped channel, said device comprising:

a support body having a first side, an opposite side and a pair of lateral sides extending between the first side and the opposite side, said first side being receivable in a portion of said channel and the portion of said body adjacent said first side decreasing in thickness in the direction toward said first side;

a hollow projection on a face of said body in spaced relation to said first side, said projection having a pair of spaced apertures therein for receiving a hook, said apertures being aligned along a line extending at an acute angle with respect to the plane of said face of said body;

a first resilient arm extending from one lateral side of said body, said arm having a portion which is receivable in another portion of said channel and which decreases in thickness in the direction away from said first side;

a second resilient arm extending from the other lateral side of said body, said second arm having a portion which is receivable in said other portion of said channel and which decreases in thickness in the direction away from said first side; and a relatively long and narrow hook having a free end and an opposite end, said opposite end of the hook having a leg extending transversely to the length of said hook, said leg being detachably received in said aperture in said projection.

13. In combination with a C-shaped channel having inturned edge portions providing a pair of spaced recesses, an article supporting device comprising:

a support body having a first side, an opposite side and a pair of lateral sides extending between the first side and the opposite side, the portion of said body adjacent said first side decreasing in thickness in cross-section, in the direction toward said first side;

a hollow projection on a face of said body in spaced relation to said first side, said projection having a pair of spaced apertures therein for receiving a hook, said apertures being aligned along a line extending at an acute angle with respect to the plane of said face of said body;

a first resilient arm extending from one lateral side of said body; and a second resilient arm extending from the other lateral side of said body, said body being mounted on said channel with said first side in one of said recesses, with a portion of each of said arms in the other of said recesses and with said face of said body facing away from said channel, each said portion of each said arm decreasing in thickness in the direction away from said first side.

* * * * *